United States Patent [19]

Vatsvog

[11] 4,196,670

[45] Apr. 8, 1980

[54] METHOD OF COATING BULLETS TO REDUCE THE LEADING EFFECT THEREOF ON THE BORES OF FIREARMS

[76] Inventor: Marlo K. Vatsvog, 4221 S. 185th St., Seattle, Wash. 98188

[21] Appl. No.: 876,330

[22] Filed: Feb. 9, 1978

[51] Int. Cl.[2] ..... F42B 11/00

[52] U.S. Cl. ..... 102/92.2; 102/92; 427/335; 427/419.7

[58] Field of Search ..... 102/42, 92, 92.2; 427/335, 419 F

[56] References Cited

U.S. PATENT DOCUMENTS

| | | | |
|---|---|---|---|
| 2,772,634 | 12/1956 | Oberfell | 102/42 R |
| 3,267,035 | 8/1966 | Tillman | 102/92 |
| 3,356,029 | 12/1967 | Seidel | 102/92 |

*Primary Examiner*—Verlin R. Pendegrass
*Attorney, Agent, or Firm*—Seed, Berry, Vernon & Baynham

[57] ABSTRACT

A method is disclosed for coating bullets to reduce the "leading effect" thereof on the gun bores of firearms by coating each bullet, prior to loading, with a dry film lubricant composition, the lubricant composition including molybdenum disulfide dispered in a suitable carrier such as a synthetic resin dissolved in a volatile hydrocarbon solvent which evaporates on exposure to the atmosphere leaving a thin coating on each bullet. The lubricant coating has a further advantage in that it does not clog the mechanism of automated machines for loading bullets into shell casings therefor.

2 Claims, No Drawings

METHOD OF COATING BULLETS TO REDUCE THE LEADING EFFECT THEREOF ON THE BORES OF FIREARMS

BACKGROUND OF THE INVENTION

1. Field of the Invention

This invention is directed to a method of coating bullets to reduce the "leading effect" thereof on bores of firearms through which the bullet is projected and to a means of preventing fouling of automated equipment used for loading bullets into shell casings therefor.

It is a common practice in loading bullets into shell cases to coat each bullet, prior to loading, with a lubricant to reduce the "leading effect" of the bullet on the bore of the firearm through which the bullet is projected. The most commonly used lubricant is beeswax which presents a problem in that a residue of the beeswax slowly builds up on the loading mechanism of automatic equipment used to load the bullets into the shell cases. This residue eventually clogs the mechanism to the point that it requires curtailment of production for the purpose of disassembling the loading equipment for cleaning.

It has remained a problem to find suitable compositions for coating bullets without at the same time creating problems in use of automated loading equipment.

SUMMARY OF THE INVENTION

A primary object of this invention is to provide a method for coating bullets with a composition which reduces the "leading effect" of the bullet on the bore of a gun without, at the same time, fouling the mechanism of automated equipment used for loading bullets into shell casings therefor, the composition containing molybdenum disulfide dispersed in a suitable carrier therefor such as a synthetic resin which is dissolved in a volatile hydrocarbon solvent. The coating is allowed to dry on the bullets by evaporation of the volatile solvent before loading the coated bullets into shell cases.

This and other objects are accomplished by coating bullets prior to their being pressed into shell cases with a coating of a composition containing molybdenum disulfide dispersed in a carrier therefor, such as a resin dissolved in a volatile hydrocarbon solvent, the solvent being allowed to evaporate leaving a thin dry coating on each bullet. The bullets are then fed into an automatic loading mechanism where they are pressed into shell cases.

DETAILED DESCRIPTION OF THE PREFERRED EMBODIMENTS

The conventional process for making cartridges for firearms is one of casting bullets from molten lead in bulk, removing them from the casting, coating the bullets with a suitable lubricant (traditionally beeswax) and either selling the bullets as is or introducing them into a sizing machine where they are sized for loading into shell casings. Automated equipment is available for loading the coated bullets into shell casings; however, the traditional lubricants used slowly build up residues on the loading mechanism of the automated equipment, eventually requiring shutdown of the equipment for cleaning and maintenance.

The method described herein overcomes the problem of buildup of residue of the traditional lubricants used for coating bullets as it affects automatic loading equipment. It was found that coating of the bullets with a thin film of a lubricating composition containing molybdenum disulfide dispersed in a carrier therefor such as a lacquer-like resin vehicle overcame the problem associated with the automatic loading mechanism as well as reducing the "leading effect" of bullets on the gun bores from which the bullets were projected.

A composition containing molybdenum disulfide which may be used in the method described herein is a commercially available product known as a "dry film lubricant" used for coating metallic and non-metallic surfaces, primarily for corrosion protection. One such product is made by Sandstrom Products Company of Port Byron, Illinois and is known as Sandstrom 47-A Dry Film Lubricant. It contains inhibited molybdenum disulfide in an epoxy phenolic resin vehicle. The composition has a viscosity of 21 seconds as determined by #2 Zahn cup, a solids content of 36% and contains corrosion inhibiting pigments. Generally the composition is blended with a volatile hydrocarbon solvent such as methylene chloride or dioxane, for application by spraying or dipping to metal parts.

The bullets after being cast are dipped in a solution of the composition containing molybdenum disulfide, such as Sandstrom 47-A Dry Film Lubricant thinned with 1½ parts methylene chloride to one part of the dry film lubricant. The bullets after being dipped into the dry film lubricant composition are removed and allowed to air dry by evaporation of the solvent therefrom. The bullets with the film coating are then fed into the load tube of the automatic loading mechanism of a conventional machine which presses the bullets into the shell casings therefor.

A primary advantage of the coating is that the coated bullets reduce the "leading effect" on gun bores through which the bullets are projected. It is well known that leaded bullets without any coating tend to gaul the bores of guns. It was unexpected that coating of bullets with composition described previously would have the effect of reducing the leading effect of such bullets on gun bores through which they are projected.

The lubricant coating is a lower friction coating which exhibits long-wear life and is virtually unaffected by atmospheric corrosion, solvents, acids, oils and/or degreasers.

I claim:

1. A method of treating bullets to reduce the leading effect on gun bores through which the bullets are projected, comprising:

dissolving an epoxy phenolic resin in a hydrocarbon solvent therefor selected from the group consisting of methylene chloride and dioxane;

dispersing molybdenum disulfide in the carrier/resin mixture;

coating the bullets with the composition; and allowing the hydrocarbon solvent to evaporate by exposure of the bullets to air, leaving a thin coating of the resin/molbydenum disulfide composition on the surface of the bullets.

2. A method of treating bullets to reduce the leading effect thereof on gun bores and at the same time not foul the loading mechanism of automated equipment used for loading bullets into shell casings therefor, comprising:

coating each bullet, prior to its being pressed into its shell case, with a thin coating of a composition consisting of an epoxy phenolic resin dissolved in a hydrocarbon solvent selected from the group consisting of methylene chloride and dioxane into which is dispersed molybdenum disulfide;

allowing the hydrocarbon solvent to evaporate on exposure of the bullets to air, leaving a thin coating of the molybdenum disulfide/resin on the surface of the bullets; and pressing the coated bullets into their respective shell casing.

* * * * *